US012364295B2

(12) United States Patent
Pruvost et al.

(10) Patent No.: US 12,364,295 B2
(45) Date of Patent: Jul. 22, 2025

(54) METHOD FOR MANUFACTURING A PROTECTIVE GLOVE PROVIDED WITH A TEARABLE JOINT

(71) Applicant: SPONTEX, Colombes (FR)

(72) Inventors: Ingrid Pruvost, Colombes (FR); Hervé Deffrenne, Colombes (FR); Christiane Saunier, Colombes (FR)

(73) Assignee: SPONTEX, Colombes (FR)

( * ) Notice: Subject to any disclaimer, the term of this patent is extended or adjusted under 35 U.S.C. 154(b) by 709 days.

(21) Appl. No.: 17/761,251

(22) PCT Filed: Sep. 22, 2020

(86) PCT No.: PCT/EP2020/076440
§ 371 (c)(1),
(2) Date: Mar. 17, 2022

(87) PCT Pub. No.: WO2021/058486
PCT Pub. Date: Apr. 1, 2021

(65) Prior Publication Data

US 2022/0369741 A1 Nov. 24, 2022

(30) Foreign Application Priority Data

Sep. 24, 2019 (FR) ..... 1910544

(51) Int. Cl.
*A41D 19/00* (2006.01)
*A41D 19/04* (2006.01)

(52) U.S. Cl.
CPC ..... *A41D 19/0065* (2013.01); *A41D 19/0082* (2013.01); *A41D 19/04* (2013.01)

(58) Field of Classification Search
CPC . A41D 19/0065; A41D 19/0082; A41D 19/04
See application file for complete search history.

(56) References Cited

U.S. PATENT DOCUMENTS 4,131,952 A * 1/1979 Brenning, Jr. ..... A41D 19/015 2/124
9,072,326 B2 7/2015 Becker et al.
2018/0055114 A1* 3/2018 Kim ..... A41D 19/01576

FOREIGN PATENT DOCUMENTS

EP 3290554 A1 3/2018
KR 20140079149 A 6/2014
KR 101713763 B1 3/2017

OTHER PUBLICATIONS

International Search Report issued in corresponding application No. PCTEP2020076440 dated Nov. 19, 2020.

* cited by examiner

*Primary Examiner* — Nathan T Leong
(74) *Attorney, Agent, or Firm* — Eversheds Sutherland (US) LLP

(57) ABSTRACT

The invention relates to a method for manufacturing a protective glove. The method includes the production of a textile support member having a zone for joining a portion of the support member to the remainder of the support member. A polymer coating solution is applied to a portion of the textile support member including the joint zone. The textile support member is processed so that the solution forms a polymer coating on the external surface the joint zone. The coated joint zone is designed to totally destroy the textile support member in the zone in order to form a joint between the portion and the remainder of the support member and the joint is formed by the polymer coating. The joint is able to tear under the effect of a threshold force for tearing off the portion.

13 Claims, 3 Drawing Sheets

METHOD FOR MANUFACTURING A PROTECTIVE GLOVE PROVIDED WITH A TEARABLE JOINT

CROSS-REFERENCE TO RELATED APPLICATIONS

This application claims the benefit of International application number PCT/EP2020/076440, filed Sep. 22, 2020 and French patent application number 1910544, filed on Sep. 24, 2019, the entire contents of which are incorporated herein by reference.

TECHNICAL FIELD

The invention relates to a method for manufacturing a protective glove, as well as a protective glove manufactured by means of such a method.

BACKGROUND

In particular, it applies to protective gloves intended to be worn in an industrial environment, in particular during the use of machines comprising a rotating tool.

Protective gloves comprising a textile support member designed to cover the fingers and at least the proximal portion of the hand of a wearer are known. In particular, the textile support member may be formed by seamless knitting, which, in addition to being easy to manufacture, enables it to conform easily to the hand of the wearer, and thus guarantee to said wearer good comfort in use.

Such gloves also have a polymer coating, in particular based on polyurethane or nitrile rubber, which extends over at least one portion of the external surface, in particular the palmar zone of the textile support member, in order to protect the hand against the risks of cutting by a sharp tool.

To manufacture such a glove, a method is known which provides for:

- the production of a textile support member as described before;
- the application of a polymer coating solution to at least one portion of the textile support member, in particular the palmar zone;
- the processing of said textile support member so that said solution forms a polymer coating on the external surface of the considered portion.

To enable the wearer to easily clear his hand in the event of snagging of his glove in a rotating tool, it is known to form a joint between a portion and the remainder of said glove, said joint being designed to be able to tear under the effect of a threshold force for tearing off said portion.

In particular, such joints may be formed on a sleeve for covering a finger, and more particularly at the base of such a sleeve, in order to avoid said finger being driven into a machine, and thus avoid a serious accident for the wearer.

To form such a joint, the document U.S. Pat. No. 9,072,326 provides for:

- producing the textile support member with at least one first textile yarn, and forming a joint zone between a portion and the remainder of said support member by means of a second textile yarn whose resistance to tearing is lower than that of said first yarn;
- applying a polymer coating solution at least to said joint zone, so as to form a tearable joint comprising the second yarn and said coating.

Nonetheless, this solution is not entirely satisfactory, in that the joint has a resistance to tearing which remains particularly high.

SUMMARY OF THE INVENTION

The invention aims to improve the prior art by providing in particular a glove wherein joints with a sufficiently low resistance to tearing are formed to guarantee the safety of the wearer in the event of snagging of said glove in a rotating tool.

To this end, according to a first aspect, the invention provides a method for manufacturing a protective glove, said method providing for:

- the production of a textile support member designed to cover the fingers and at least the proximal portion of the hand of a wearer, said textile support member having at least one zone for joining a portion of said support member to the remainder of said support member;
- the application of a polymer coating solution to at least one portion of the textile support member including the joint zone;
- the processing of said textile support member so that said solution forms a polymer coating on the external surface of at least the joint zone;
- said method providing for a processing of the coated joint zone which is designed to totally destroy the textile support member in said zone in order to form a joint between the portion and the remainder of the support member which is formed by the polymer coating, said joint being designed to be able to tear under the effect of a threshold force for tearing off said portion.

According to a second aspect, the invention provides a protective glove manufactured by means of such a method, said glove comprising a textile support member designed to cover the fingers and at least the proximal portion of the hand of a wearer, the external surface of said textile support member being provided with a polymer coating at least at the joint between a portion of said support member and the remainder of said support member, said joint being formed of the single polymer coating which is designed to be able to tear under the effect of a threshold force for tearing off said portion.

BRIEF DESCRIPTION OF THE DRAWINGS

Other particularities and advantages of the invention will appear in the following description, made with reference to the appended figures, wherein.

DETAILED DESCRIPTION OF THE DRAWINGS

Figure 1:
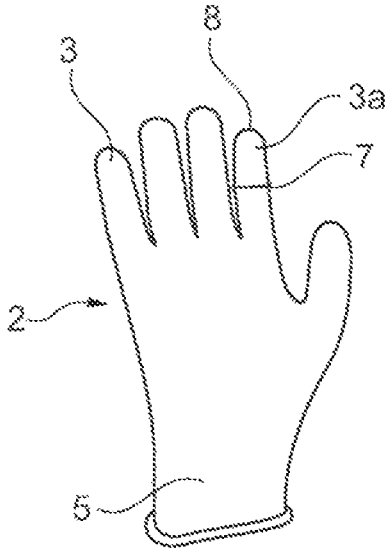
FIG. 1 schematically represents a textile support member for a glove according to an embodiment of the invention, FIG. 1*a* representing an enlargement of a sleeve for covering a finger provided with a joint zone.

With reference to these figures, a method for manufacturing a protective glove 1 is described below, as well as a protective glove 1 manufactured by means of such a method.

The method provides for producing a textile support member 2 designed to cover the fingers and at least the proximal portion of the hand of the wearer.

In the represented embodiment, the textile support member 2 comprises five sleeves 3, 3*a* for covering respectively a finger of the wearer, a central portion 4 covering the proximal portion of the hand, and a portion 5 covering the wrist of the wearer, said wrist portion being provided with an opening through which the wearer can put on the glove 1.

The method may provide for producing the textile support member 2 by knitting, which enables the glove 1 to conform easily to the hand of the wearer, and thus guarantee to said wearer good comfort in use.

The textile support member 2 is made with at least one structural yarn 6 composed of natural and/or synthetic fibres, in particular based on polyamide, polyester, acrylic, viscose, cotton, wool, linen, hemp and/or bamboo.

Advantageously, the structural yarn 6 comprises fibres that have a high resistance to cutting, which allows guaranteeing to the wearer of the glove 1 good protection against the risk of being cut by a cutting tool.

To this end, the structural yarn 6 may comprise, for example, fibres chosen from the following materials:

- High Performance Poly Ethylene (HPPE), marketed in particular under the trademarks Dyneema®, Spectra® or Tsunooga®;
- polyaramid, marketed in particular under the trademarks Kevlar® or Twaron®;
- liquid crystal polymer, marketed in particular under the trademark Vectran®;
- polyimide;
- glass;
- steel.

The textile support member 2 has at least one zone 7 for joining a portion 8 of said support member with the remainder of said support member, the method providing for subsequently forming a tearable joint 9 at said zone.

The method may provide for forming the joint zone 7 over 1 to 5 rows, in particular over 1 to 3 rows of knitting, which allows obtaining a tearable joint 9 with enough width to guarantee a good tearing of the glove 1 in the event of snagging in a rotating tool.

Advantageously, the joint zone 7 is formed on at least one sleeve 3*a* covering a finger. Indeed, when using a rotating tool, the fingers are the part of the hand presenting the highest risk of being caught by said tool. According to an advantageous embodiment, each of the sleeves 3*a* covering a finger is provided with a joint zone 7.

Figure 1A:
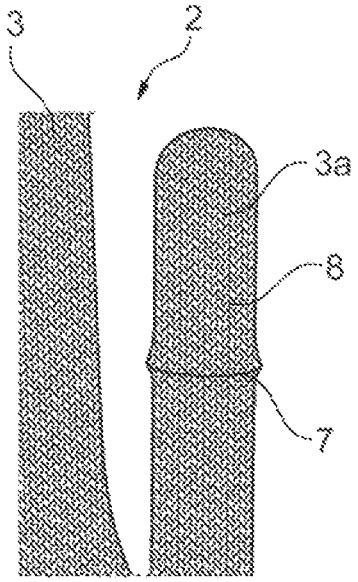

In FIGS. 1 and 1*a*, the joint zone 7 is formed on the sleeve 3*a* covering the index finger, in particular between the proximal and intermediate phalanges, the end portion 8 of said sleeve thus being separable from the remainder of the glove 1 in the event of snagging in a rotating tool.

Alternatively, the joint zone 7 could be formed, for example, at the base of a sleeve 3, 3*a* covering a finger, or even on the central portion 4 covering the hand.

Afterwards, the method provides for the application of a solution 10 of a polymer coating 11 on at least one portion of the textile support member 2 including the joint zone 7, in particular in order to preserve the integrity of the glove 1, protect it from oils and lengthen its service life.

In particular, the method may provide for making the coating 11 from a polymer chosen from the following group: polyurethane, polyurea, natural latex, nitrile rubber, polychloroprene, fluoro-polymer, butyl latex, chlorosulfonated polyethylene (CSM), PVC, a combination of these compounds.

In particular, as regards a latex-based coating, the method may provide for applying a coagulant on at least one portion of said textile support member including the joint zone 7, the polymer coating solution 10 then being applied on said coagulant.

In particular, the method may provide for applying the coagulant by soaking the textile support member 2 in a bath 12 of a coagulating solution, then drying said coagulant prior to the application of the polymer coating solution 10.

Figure 2A:
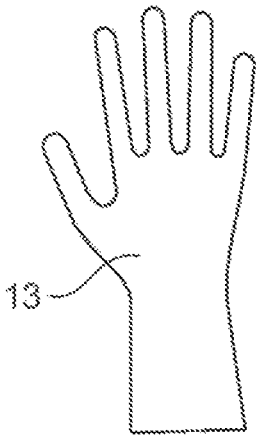
FIG. 2*a*, FIG. 2*b*, FIG. 2*c*, FIG. 2*d*, FIG. 2*e*, FIG. 2*f* and FIG. 2*g* represent successive steps of a method for manufacturing a glove according to an embodiment of the invention, in particular from the textile support member of FIGS. 1 and 1*a;*
Figure 2B:
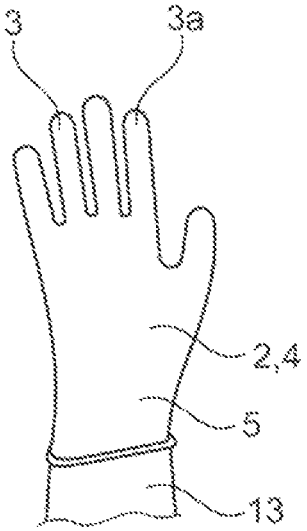
Figure 2C:
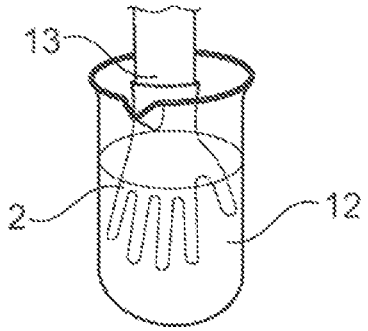
Figure 2D:
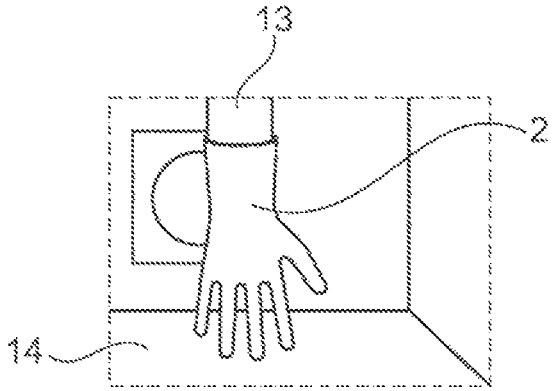

In the represented embodiment, the textile support member 2 is first fitted onto a hand-like shaped base 13, in particular made of a metallic material (FIGS. 2*a*, 2*b*), then soaked by means of said base in a bath 12 of a coagulating solution, in particular based on calcium nitrate and water (FIG. 2*c*). Afterwards, the textile support member 2/base 13 set is placed in an oven 14 at 60° C. to ensure the drying of the coagulant on said support member (FIG. 2*d*).

Depending on the desired protection level, the method may provide for applying the coating solution 10 on the entire textile support member 2, on about 75% of the external surface of said textile support member, or only on the palmar zone of said textile support member.

Advantageously, the method may provide for applying the polymer coating solution 10 by soaking the textile support member 2 in a bath 15 of said solution, which allows easily making the coating 11 on the desired areas of the glove 1.

Figure 2E:
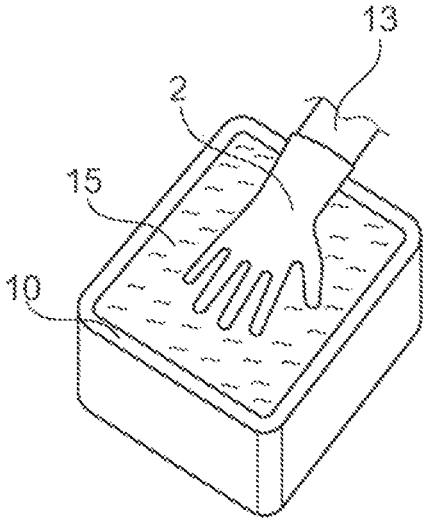

In FIG. 2*e*, the textile support member 2/base 13 set is placed in a bath 15 of polymer coating solution 10 so as to immerse the palmar zone and the interdigital spaces of said support member therein, in order to ensure protection on an important surface of the glove 1.

Afterwards, the method provides for the processing of the textile support member 2 so that the solution 10 forms a polymer coating 11 on the external surface of at least the joint zone 7.

To form the polymer coating 11, the method may provide for applying a heat treatment, in particular to crosslink the polymer coating solution 10. In particular, this crosslinking may be carried out at a temperature higher than or equal to 100° C.

Figure 2F:
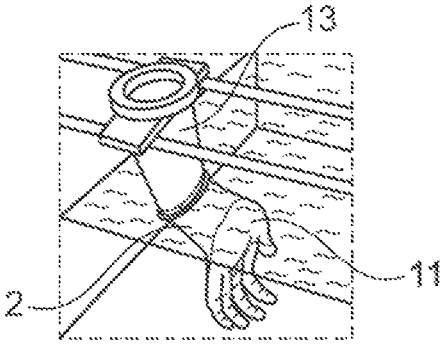

In the represented embodiment, the textile support member 2/base 13 set, after soaking in the polymer coating solution 10, is rinsed with demineralised water, in particular to remove the excess solution 10 (FIG. 2*f*), then placed in an oven 16 at 100° C. to form the coating 11 by crosslinking said polymer solution.

Finally, after complete crosslinking of the solution 10, the obtained textile support member 2/coating 11 set is removed off its base 13.

The method provides for a processing of the coated joint zone 7 which is designed to totally destroy the textile support member 2 in said zone, in order to form a joint 9 between the portion 8 and the remainder of said support member which is formed by the polymer coating 11, said joint being designed to be able to tear under the effect of a threshold force for tearing off said portion.

Figure 3A:
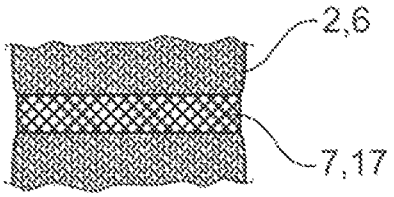
FIG. 3*a* represents an enlargement showing a joint zone of a glove according to the invention before the processing for destroying the textile support member.
Figure 3B:
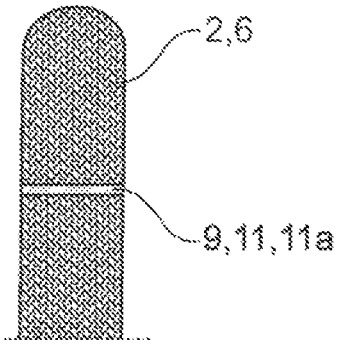
FIG. 3*b* represents, from inside the glove, the tearable joint obtained after the processing for destroying the textile support member.

Thus, as represented in FIGS. 3*a* and 3*b*, a protective glove 1 is obtained with a tearable joint 9 formed of the polymer coating 11 alone, which allows conferring on said joint a resistance to tearing low enough to guarantee tearing of portion 8 in the event of snagging in a rotating tool.

To form the tearable joint 9, the method may provide for cutting the joint zone 7 over its entire thickness, in particular by laser cutting, or by water jet cutting.

The method may also provide for forming the tearable joint 9 by chemically removing the joint zone 7 over its entire thickness.

According to one embodiment, the method provides, during production of the textile support member 2, to make the joint zone 7 with a degradable yarn 17 instead of the structural yarn 6 used for the remainder of said support member, then to subsequently apply a treatment of total degradation of said yarn to form the tearable joint 9.

For this purpose, the method may provide for making the joint zone 7 with a soluble yarn 17, then applying a treatment to solubilise said yarn for total removal thereof from said zone.

Advantageously, the method may provide for the removal of the water-soluble yarn 17 during the treatment of rinsing the polymer coating 11 (FIG. 2*f*), which allows reducing the number of steps necessary for the manufacture of the glove 1, and thus facilitating said manufacture. In particular, the rinsing treatment allows removing excess coagulation agent and surfactant agent from the polymer coating 11.

The method may provide for the use of a water-soluble polyvinyl alcohol yarn 17, the dissolution of which is carried out at a temperature lower than or equal to the temperature of the rinsing bath of the polymer coating 11 and in a time equal to or shorter than the rinsing treatment duration.

In particular, the material forming the soluble yarn 17 may have a dissolution temperature comprised between 30° C. and 60° C., and in particular between 40° C. and 50° C. for a dissolution duration comprised between 15 minutes and 120 minutes, and in particular between 30 minutes and 60 minutes. The temperature of the rinsing bath will advantageously be adjusted according to the duration of the rinsing treatment.

According to another embodiment, the method provides for making the joint zone 7 with a hot-melt yarn 17, then applying a heat-treatment of said zone to remove said yarn.

Figure 2G:
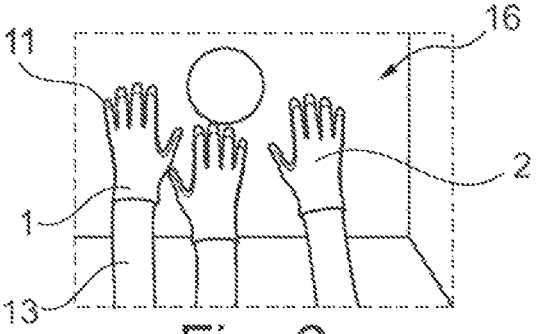

Advantageously, the method may provide for removing the hot-melt yarn 17 during the crosslinking heat-treatment of the polymer coating 11 (FIG. 2*g*), which allows reducing the number of steps necessary for the manufacture of the glove 1, and thus facilitate said manufacture.

For this purpose, the method may provide for the use of a hot-melt yarn 17 with a melting temperature lower than or equal to the crosslinking temperature of the polymer coating 11. In particular, the material forming the hot-melt yarn 17 may have a melting temperature comprised between 60° C. and 100° C., and in particular between 60° C. and 80° C.

As example, the hot-melt yarn 17 could be based on a VLT yarn marketed under the trademark Grilon®, said yarn having a melting temperature in the range of 60° C.

The method may also provide for a treatment of the polymer 11 a coating the joint zone 7 to reduce its mechanical resistance to tearing. This treatment may comprise:

a reduction in the thickness of the polymer coating 11*a* of the joint 9; and or an alteration of the material of said coating at said joint.

According to one embodiment, the method may provide for treating the polymer coating 11*a* of the joint 9 together with the coated joint zone 7, in particular by (laser or water jet) cutting or chemical treatment, in order to make the final tearable joint 9 in one step.

For this purpose, the method may provide, after the step of forming the polymer coating 11 (FIG. 2*g*) and demoulding of the glove 1 off its metal base 13, for:

turning said glove over so as to present its internal surface, and therefore the textile support member 2, to the outside;

putting on said glove thus turned over on a second hand-like shaped base;

making the tearable joint 9 by jointly treating the textile zone 7 and the coating 11*a* covering it.

In the case of laser or water jet cutting, it is necessary to put the glove 1 on a two-dimensional support member, in order to benefit from good flatness of said glove, and thus be able to make said cut in a very accurate manner, in depth as well as in width.

What is claimed is:

1. A method for manufacturing a protective glove, the method providing for:

producing a textile support member configured to cover the fingers of a wearer and at least the proximal portion of the hand of the wearer, the textile support member having at least one zone or joining a first portion of the textile support member to the remainder of the textile support member;

applying a polymer coating solution to at least one portion of the textile support member including the joint zone;

processing the textile support member in the polymer coating solution to form a polymer coating on the external surface of the joint zone;

the method wherein the processing of the coated joint zone totally destroys the textile support member in the joint zone to form a tearable joint between the first portion and the remainder of the textile support member which is formed by the polymer coating, the tearable joint being configured to tear under the effect of a threshold force for tearing off first portion.

2. The method according to claim 1, wherein the textile support member is made with at least one structural textile yarn, the joint zone being made with a degradable yarn and applying a treatment of total degradation of the degradable yarn to form the tearable joint.

3. The method according to claim 2, wherein the joint zone is made with a hot-melt yarn, and a heat treatment of the joint zone to remove the hot-melt yarn.

4. The method according to claim 3, wherein a heat treatment is applied to form the polymer coating, the hot-melt yarn being removed during the heat treatment.

5. The method according to claim 2, wherein the joint zone is made with a soluble yarn, the method providing for a solubilisation treatment of the yarn in order to remove it from the joint zone.

6. The method according to claim 5, wherein a rinsing treatment of the polymer coating is applied, the soluble yarn being removed during the rinsing treatment.

7. The method according to claim 1, wherein the joint zone is cut over the joint zone entire thickness to form the tearable joint.

8. The method according to claim 1, wherein the joint zone is chemically removed over the joint zone entire thickness to form the tearable joint.

9. The method according claim 1, wherein the polymer coating treatment of the joint zone reduces the mechanical resistance of the joint zone to tearing.

10. The method according to claim 9, wherein the treatment of the polymer coating of the joint zone comprises a reduction in the thickness of the polymer coating of the joint.

11. The method according to claim 1, wherein the method provides for producing the textile support member by knitting.

12. The method according to claim 11, wherein the method provides for forming the tearable joint on at least 1 to 3 rows of knitting.

13. The method according to claim 1, wherein the method provides for producing the coating from a polymer selected from the following group: polyurethane, polyurea, natural latex, nitrile rubber, polychloroprene, fluoro-polymer, butyl latex, chlorosulfonated polyethylene (CSM), PVC, a combination of these compounds.

* * * * *